US005531872A

United States Patent [19]

Forgit et al.

[11] Patent Number: 5,531,872

[45] Date of Patent: Jul. 2, 1996

[54] PROCESSES FOR PREPARING PHOTOCONDUCTIVE MEMBERS BY ELECTROPHORESIS

[75] Inventors: Rachael A. Forgit, Rochester; Ronald E. Godlove, Bergen; John S. Chambers, Rochester; Huoy-Jen Yuh, Pittsford; Robert E. McCumiskey, Rochester; Kamran U. Zaman, Henrietta; William G. Herbert, Williamson, all of N.Y.

[73] Assignee: Xerox Corporation, Stamford, Conn.

[21] Appl. No.: 288,860

[22] Filed: Aug. 11, 1994

[51] Int. Cl.[6] ..... C25D 13/00

[52] U.S. Cl. ..... 204/486; 430/127

[58] Field of Search ..... 204/180.2, 181.5, 204/181.1; 430/58, 270, 135, 130, 133, 134, 127

[56] References Cited

U.S. PATENT DOCUMENTS

| | | | |
|---|---|---|---|
| 3,674,670 | 7/1972 | Erikson et al. | 204/181 |
| 3,825,422 | 7/1974 | Gruber et al. | 96/1 PE |
| 3,844,908 | 10/1974 | Matsuo et al. | 204/35 N |
| 3,844,919 | 10/1974 | Shiota | 204/181.4 |
| 3,870,614 | 3/1975 | Underwood | 204/181.5 |
| 3,935,087 | 1/1976 | Jerabek et al. | 204/181 |
| 3,941,593 | 3/1976 | Butement | 430/103 |
| 3,956,524 | 5/1976 | Weigl | 427/40 |
| 4,592,816 | 6/1986 | Emmons | 204/180.6 |
| 4,761,212 | 8/1988 | Watanabe et al. | 204/181.1 |
| 4,952,293 | 8/1990 | Sypula et al. | 204/180.7 |
| 5,206,359 | 4/1993 | Mayo et al. | 540/141 |
| 5,226,317 | 7/1993 | Irie et al. | 73/61.79 |
| 5,258,461 | 11/1993 | Facci et al. | 525/165 |

*Primary Examiner*—John Niebling
*Assistant Examiner*—Brendan Mee
*Attorney, Agent, or Firm*—Zosan S. Soong

[57] ABSTRACT

A process is disclosed for fabricating a photoconductive member comprising: depositing a photoconductive material and a charge transport material on a substrate, sequentially in any order, or simultaneously, wherein the photoconductive material, the charge transport material, or both, are electrophoretically deposited onto the substrate from a liquid composition.

7 Claims, No Drawings

PROCESSES FOR PREPARING PHOTOCONDUCTIVE MEMBERS BY ELECTROPHORESIS

This invention relates generally to the fabrication of a photosensitive or photoconductive member. More specifically, the present invention relates to processes for depositing one or more of the layers of a photoreceptor by electrophoresis.

There is a need for new processes which can quickly deposit layered material, especially photoconductive material and/or charge transport material, onto a photoreceptor substrate in a thin, uniform coating. There is also a need for new coating processes which can minimize the use of liquid mediums such as solvents, as compared with a dip coating operation. Dip coating of the charge generating material layer is a complex process in which the pigment particles must be dispersed in a stable solution. A stable solution is defined as a solution in which the pigment particles do not agglomerate or settle. Electrophoretic coating of the charge generating material layer as disclosed herein would allow one to coat a less stable solution. Settling is no longer a concern and the solutions could be of higher loadings, less solvent and increased solids content. The inventive coating method disclosed herein also may minimize the processing time of the charge generating solutions.

Electrophoresis is the migration of suspended or colloidal particles in a liquid due to the effect of a potential difference between immersed electrodes. The migration of the particles is towards the electrode that has a charge opposite to that of the particle. Particles lose their charge at the electrode and tend to agglomerate there. In electrophoresis, the ability to control the thickness is primarily due to the particles losing their charge when they reach the electrode. Because the particles do not attract more particles after they reach the electrode, the process is generally self-limiting. Electrophoresis is used to apply primer paint to automobiles wherein the metal piece to be coated becomes the anode in a tank with paint particles which are oppositely charged and dispersed in water. It is believed to be a novel approach to employ electrophoresis in the fabrication of photoreceptors.

Weigl, U.S. Pat. No. 3,956,524, discloses a photoreceptor fabrication method which coats a substrate with a liquid dispersion, exposes the liquid dispersion to a direct stream of corona ions or a high intensity DC electric field to cause separation of the dispersion into a two layered structure, one layer being comprised of photoconductive material.

Matsuo et al., U.S. Pat. No. 3,844,908, discloses a process for coloring aluminum or aluminum alloy products subsequent to anodically oxidizing the surface of the aluminum or aluminum alloy products.

Facci et al., U.S. Pat. No. 5,258,461, discloses the electrocodeposition of polymer blends for photoreceptor substrates.

Erikson et al., U.S. Pat. No. 3,674,670, discloses an electrodeposition coating method.

Gruber et al., U.S. Pat. No. 3,825,422, discloses the use of vanadyl and titanyl phthalocyanine in photoelectrophoretic imaging systems.

Jerabek et al., U.S. Pat. No. 3,935,087, discloses a method for electrodeposition of self-crosslinking cationic compositions.

Watanabe et al., U.S. Pat. No. 4,761,212, discloses a coating method comprising applying a cationic electrophoretic primer to a substrate.

Irie et al., U.S. Pat. No. 5,226,317, discloses in col. 1 that automobiles and building articles are generally coated by electrodeposition coating.

Mayo et al., U.S. Pat. No. 5,206,359, discloses in col. 1, lines 64–68, that titanyl phthalocyanines may be selected as intense blue light stable colorants for use in coatings, such as paint, inks, and as near infrared absorbing pigments suitable for use as IR laser optical recording materials.

SUMMARY OF THE INVENTION

It is an object of the present invention in embodiments to provide a process which can quickly deposit layered material, especially photoconductive material and/or charge transport material, onto a photoreceptor substrate in a thin, uniform coating.

It is also an object in embodiments to provide a process which can deposit layered material, especially photoconductive material and/or charge transport material, onto a photoreceptor substrate in the optional presence of a binding material.

These objects and others are accomplished in embodiments by providing a process for fabricating a photoconductive member comprising: depositing a photoconductive material and a charge transport material on an already fabricated substrate, wherein either material is electrophoretically deposited.

In embodiments, there is also provided a process for fabricating a photoconductive member comprising:

(a) depositing electrophoretically a photoconductive material onto a substrate from a liquid composition; and (b) depositing a charge transport material on the substrate either prior to or subsequent to (a).

There is further provided in embodiments of the instant invention a process for fabricating a photoconductive member comprising depositing electrophoretically an inorganic photoconductive material onto a substrate from a liquid composition.

DETAILED DESCRIPTION

As used herein, the terms electrophoresis, electrophoretically, and similar terms refer to the movement or migration of suspended or colloidal particles in a liquid due to the effect of a potential difference between at least partially immersed electrodes.

Electrophoretic deposition may occur on a substrate devoid of layered material or on a substrate previously coated with layered material, the layered material being for example one or more of the following: a charge blocking layer, a photoconductive material including a charge generating material, a charge transport material, and any other layered material typically employed in photoreceptors. Thus, as used herein, the term substrate is not limited to a substrate devoid of layered material.

Electrophoretic deposition on the substrate may be accomplished in embodiments by the following preferred procedure. A portion of a substrate, ranging for example from about 50% to 100% of its outer surface area, is positioned in a liquid composition comprised of a liquid medium and a photoconductive material such as a charge generating material (also referred to herein as "CGM") and/or a charge transport material (also referred to herein as "CTM"). The substrate comprises one electrode. A second electrode of any suitable configuration such as a bar or a cylinder, preferably fabricated from a metal such as nickel or aluminum, is positioned in the liquid composition and spaced from the substrate. The substrate and the electrode are separated by an effective distance, ranging for example from about 10 mm to about 10 cm. The substrate and the electrode are coupled to a power source. An electric field is created in the liquid composition between the substrate and electrode. Particles of the photoconductive material and/or charge transport material, which have an opposite charge to that of the substrate, migrate or move towards the substrate and deposit thereon. The photoconductive material and the charge transport material may be deposited on the substrate sequentially in any order, or simultaneously. In embodiments, it is not required that both the photoconductive material and the charge transport material are deposited electrophoretically; either the photoconductive material or the CTM may be deposited by conventional coating techniques such as brushing, dip coating, spraying, gravure coating, Mayer bar, and "Bird blade" coating. The photoconductive material and/or the CTM may be deposited on the substrate to form one or two layers, each layer having a thickness ranging for instance from about 1 to about 20 microns, and preferably from about 2 to about 7 microns.

Any appropriate power source may be employed to facilitate the electrophoretic deposition. An effective voltage, ranging for example from about 8 to about 60 volts, and preferably from about 10 to about 40 volts, is employed to create the electric field. The current ranges for example from about 100 milliamps to about 10 amps, and more preferably the ratio of amperage to grams of material coated may be minimized. Electrophoretic deposition is accomplished by maintaining the electric field for an effective period of time, ranging for instance from about 10 seconds to about 5 minutes, and preferably from about 30 seconds to about 3 minutes.

When using a water based system to disperse the charge transport or charge generating particles, the pH of the system is important. There is a pH at which the particles will have a charge of zero and will not move under an electric field. At a pH above this point, the particles will have a positive or negative charge and below this point the particles will have the opposite charge. This may allow the pH to be manipulated so that the charge on the particles can be chosen to suit the process. The pH may be chosen based on the isoelectric point of the particles which are being deposited. The preferred pH is 7 so that no neutralization may be needed prior to disposal. The pH may be brought into the desired range by adding an appropriate acid such as hydrochloric acid or sulfuric acid or an appropriate base such as sodium hydroxide.

In the liquid medium, the particles of the photoconductive material and/or the charge transport material have a preexisting charge, which may be either positive or negative, depending on the pH and the nature of the particles. Thus, depending upon the polarity of the particles of the photoconductive material and the CTL, the substrate may be either the cathode or anode during the electrophoretic deposition. In embodiments, it may be possible to reverse the polarity of the photoconductive material particles and/or CTM particles by changing the pH.

After electrophoretic deposition of the charge generating material and/or charge transport material onto the substrate, any residual liquid medium on the substrate may be removed by for example evaporation using heat and/or vacuum. The cured photoconductive material layer, CTM layer, or a single layer comprised of photoconductive material and CTL may have a thickness ranging for example from about 1 to about 100 microns, and preferably from about 20 to about 50 microns.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Å to 10 centimeters, although the thickness can be outside of this range. When a flexible electrophotographic imaging member is desired, the substrate thickness typically is from about 100 Å to about 0.015 mm. The substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metailized plastic, such as titanized or aluminized MYLAR®, wherein the metallized surface is in contact with the photosensitive layer or any other layer situated between the substrate and the photosensitive layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

The substrate may be of any dimension conventionally employed in photoreceptors. For example, in embodiments, hollow cylindrical substrates may have an inside diameter ranging from about 0.7874 inch (20 mm) to about 30 inches, an outside diameter ranging from about 0.7884 inch to about 30.5 inches, a length ranging from about 7 to about 44 inches, and a wall thickness ranging from about 0.001 to about 4 inches.

Photoconductive members of the instant invention may be fabricated with the photoconductive material and the charge transport material in the same layer or different layers. Illustrative photoconductive members, charge generating materials, charge transport materials, and photoconductive member fabrication techniques are disclosed in for example in U.S. Pat. Nos. 4,265,990; 4,390,611; 4,551,404; 4,588,667; 4,596,754; 4,797,337; 4,965,155; and 5,004,662, the disclosures of which are totally incorporated by reference.

The photoconductive material is capable in embodiments of generating electronic charge carriers in response to the absorption of radiation to be recorded by the imaging photoreceptor. The photoconductive material may be any suitable organic or inorganic photoconductor. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as indofast Orange toner, and the like; phthalocyanine pigments such as copper phthalocyanine, aluminochloro-phthalocyanine, and the like; quinacridone pigments; or azulene compounds. Suitable inorganic photoconductive materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, selenium-tellurium.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyitetraphene); poly(vinyltetracene) and poly(vinylperylene). Suitable electron transport materials include electron acceptors such as 2,4,7-trinitro-9-fluorenone; 2,4,5,7-tetranitrofluorenone; dinitroanthracene; dinitroacridene; tetracyanopyrene and dinitroanthraquinone.

A binder material may optionally be present in the liquid composition and in the layer of the photoconductive material and/or the charge transport material on the substrate. In embodiments, the binder material may facilitate adhesion of the photoconductive material and/or the CTM to the substrate. Illustrative binder materials include polycarbonate, polymethacrylates, polyarylate, polystyrene, polyester, polysulfone, styrene-acrylonitrile copolymer, styrene-methyl methacrylate copolymer, polyvinyl butyral, polyvinyl pyrrolidone, methyl cellulose, polyacrylates, and cellulose esters.

The photoconductive material and the charge transport material are present in any effective amount in the photoconductive member. Where the photoconductive material and the CTM are positioned in different layers, each material may be present in its respective layer in an amount ranging for example from about 40 to 100% by weight, and preferably from about 50 to about 90% by weight. Where the photoconductive material and the CTM are present in the same layer, each material may be present in an amount ranging for example from about 30 to about 70% by weight, and more preferably from about 40 to about 60% by weight. An optional binder material may be present in each layer of the photoconductive material and the CTM in an amount ranging for example from 0 to about 60% by weight, and preferably from about 10 to about 50% by weight. Unless otherwise indicated, the percentages of the photoconductive material and CTM refer to the amounts in the layer after curing, i.e., after exposure to heat and/or vacuum to remove the liquid medium.

The liquid composition is comprised of a liquid medium which is preferably electrically conductive and which preferably does not react detrimentally with either the photoconductive material or the charge transport material. The liquid medium may be sufficiently volatile to be easily evaporated. Suitable liquid medium include for instance water, especially deionized water, propylene carbonate, $C_1$–$C_8$ alcohol such as methanol, butanol, and pentanol, toluene, chloroform, tetrahydrofuran, benzene, dioxane, methylene chloride, butyl acetate, and cyclohexanone. The following are preferred amounts of each component of the liquid composition: a liquid medium ranging from about 50 to about 98% by weight, and especially from about 90 to about 95% by weight; a photoconductive material and/or charge transport material ranging from about 2 to about 50% by weight, and especially from about 5 to about 10% by weight; and an optional binder material ranging from about 5 to about 60% by weight, and especially from about 10 to about 35% by weight.

Optionally present on the substrate are one or more of the following layers: an adhesive layer, a charge blocking layer, an anti-curl layer, and any other layer typically employed in a photoreceptor. Compositions of each of the layers described herein are illustrated for example in Yu, U.S. Pat. No. 5,167,987, the disclosure of which is totally incorporated by reference. Some materials can form a layer which functions as both an adhesive layer and charge blocking layer. Typical blocking layers include for example metal oxides such as aluminum oxide, polyvinylbutyral, organosilanes, epoxy resins, polyesters, polyamides, polyurethanes, silicones, zirconium-silane, and the like. The polyvinylbutyral, epoxy resins, polyesters, polyamides, and polyurethanes can also serve as an adhesive layer. Adhesive layers, charge blocking layers, anti-curl layers and any other layers conventionally employed in photoreceptors may have an effective thickness, and preferably from about 0.1 to about 20 microns.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

A charge generating solution was prepared on a production scale as follows. A pigment (the charge generating material) to binder ratio of 89 to 11 weight percent was used. The binder was a polyvinylbutyral dissolved in cyclohexanone using a solvent to binder ratio of 96 to 4 by weight percent. The pigment was dibromoanthanthrone (also referred to herein as "DBA") which was dispersed in the polyvinylbutyral/cyclohexanone solution based on the pigment to binder ratio of 89 to 11 weight percent. The dispersion was dyno-milled with an appropriate media for 10 hours at 26 weight percent solids content. The solution was then diluted with cyclohexanone, centrifuged and filtered. It was then diluted again with cyclohexanone to 15 weight percent solids content with a final particle size of 0.21 to 0.22 microns for the charge generating material.

About 200 mL of the charge generating solution, as prepared above, was diluted with 400 mL of cyclohexanone in a glass beaker and mixed well on a magnetic stir plate.

The solids content of this solution was 4% by weight. Two strips of aluminum (each about 4 cm by 20 cm in size) were used as the anode and the cathode. The two strips were clipped to the inside of the glass beaker and the positive and negative electrodes were clipped to the strips. The two electrodes were connected to a power source through an amp meter. The voltage was set at 40 volts for 10 minutes. A very small current was noted, 0.01 amps. The distance between electrodes was about 10 cm. Both strips were removed from the bath and dried overnight at room temperature (about 25° C.). The anode had a thick coating on it but the cathode had a very thin transparent coating.

The two strips were then hand dipped in a solution comprised of a charge transport material to provide a thick film support for analysis of charge generating layer ("CGL") thickness. The charge transport solution comprised 14.5% polycarbonate (a binder) and 8.1% N,N'-diphenyl-N,N'-bis( 3-methylphenyl)-[1,1'-biphenyl]-4,4'diamine (a charge transport material) dissolved in monochlorobenzene. The strips were dried for 10 minutes at 100° C. The strips were submitted for cross sectioning to determine the CGL film thickness. Electrophoretic coating of DBA pigment with polyvinylbutyral binder in cyclohexanone at 40 volts for 10 minutes gave a 10.9 microns CGL film thickness at the anode and a thin discontinuous coating at the cathode. The anodic coating is over 10 times thicker than the CGL thickness provided by dip coating. Therefore less time and voltage can be used to obtain a thinner coating. The weight ratio of DBA pigment to binder in the dried CGL was believed to be in the range of 89:11 to 100:0 weight percent.

EXAMPLE 2

About 600 mL of the charge generating solution, prepared as described in Example 1, was diluted with 1200 mL of cyclohexanone and mixed to result in a dispersion with a solids content of about 4% by weight. This dispersion was used to coat a 84 mm×330 mm aluminum substrate which had a mirror lathed surface. This drum had been previously dip coated with a 0.1 micron thick blocking layer of zirconium silane. A curve of thickness versus time and voltage was established and 40 volts at 30 seconds was found to give the desired thickness of 1 micron. The drum was used as the anode and a nickel sheet which was cut to line the inside of the beaker was used as the cathode at 40 volts for 30 seconds to deposit electrophoretically the DBA pigment and the binder. The drum was dried at 100° C. for 5 minutes. The weight ratio of DBA pigment to binder in the dried CGL was believed to be in the range of 89:11 to 100:0 weight percent. After drying the drum, it was then dip coated with a charge transport solution comprised of 14.5% polycarbonate (a binder) and 8.1% N,N'-diphenyl-N,N'-bis( 3-methylphenyl)-[1,1'-biphenyl]-4,4'diamine (a charge transport material) dissolved in monochiorobenzene. The charge transport layer was dried for 45 minutes at 114° F. The thickness of the transport layer was about 20 microns.

This resulting photoreceptor device was electrically scanned to demonstrate its behavior in a photocopier. The resulting photoreceptor device was determined to be an excellent photoconductor as compared to a dip coated control photoconductor of the same size, layer thicknesses, and materials package based on the parameters listed in the table below ("V" represents voltage):

| Parameter | Photoconductor Prepared by Electrophoresis | Control Photoconductor |
|---|---|---|
| Diel thickness | 6.9 | 6.1 |
| V depletion | 87 | 176 |
| Q/A depletion | 11.1 | 25.4 |
| V0 Pidc (VH + DD) | 801 | 793 |
| Q/A (Pidc) | 104 | 131 |
| DEL Q/A | 0 | 12 |
| Dark Decay | 25 | 29 |
| % dark decay (DD 0.35 sec) | 3 | 4 |
| $V_{High}$ 0.0 ergs | 776 | 764 |
| $V_{Med}$ 3.0 ergs | 324 | 376 |
| $V_{Med}$ 5.0 ergs | 110 | 164 |
| $V_{Low}$ 25.0 ergs (0.57 sec) (550 nm) | 26 | 16 |
| dV/dX | 172 | 143 |
| Verase | 16 | 7 |
| Delta Verase | 2 | 1 |
| Temp (Pidc) | 73 | 72 |
| % Relative Humidity (Pidc) | 51 | 51 |

EXAMPLE 3

This example illustrates electrophoretic deposition of a charge transport material onto a substrate. First, 10 mL of a charge transport solution comprised of 14.5% by weight polycarbonate (a binder) and 8.1% by weight N,N'-diphenyl-N,N'-bis(3-methylphenyl)-[1,1'-biphenyl]4,4'diamine (a charge transport material) dissolved in monochlorobenzene is added to 100 mL of deionized water. This sample is shaken well to create an emulsion. Two small strips (each 6 cm by 2 cm) of aluminum is used as the anode and the cathode. The strips are submerged in the liquid and the electrodes are clipped to the strips. A field of 40 volts is applied for 10 minutes. The strips are then removed and are dried completely in an oven at 100° C.

If the anode has a thicker coating than the cathode then the micelles can be assumed to carry a negative charge. If the cathode has a thicker coating then the micelles can be assumed to be positively charged. If the two thicknesses are equal then the pH of the system is tested and adjusted and the experiment is run again. The experiment can be scaled up so that the bath will be large enough for a 40 mm by 330 mm drum to be coated electrophoretically with charge transport material.

As seen in this example, it is advantageous to select a charge transport molecule which is chemically bonded to a polymer chain. This may provide both the electrical characteristics and the mechanical characteristics needed for the charge transport layer of a photoreceptor. Dissolving the charge transport molecule and the polymer chain in an organic solvent and then dispersing this solution in another solvent in which the polymer chain is not soluble may form an emulsion. The small micelles may have a charge on them and may move toward an electrode under an electric field.

Other modifications of the present invention may occur to those skilled in the art based upon a reading of the present disclosure and these modifications are intended to be included within the scope of the present invention.

We claim:

1. A process for fabricating a photoconductive member comprising:

(a) depositing electrophoretically a layer of an organic charge generating material onto a substrate from a liquid composition; and (b) depositing by dip coating a layer of a charge transport material onto the organic charge generating material layer.

2. The process of claim 1, wherein (a) comprises: (i) positioning a portion of the substrate in the liquid composition comprised of particles of the organic charge generating material; and (ii) creating an electric field in the liquid composition to move the particles of the charge generating material toward the substrate, thereby depositing the layer of the charge generating material on the substrate.

3. The process of claim 1, wherein (a) comprises employing a current ranging from about 100 milliamps to about 10 amps.

4. The process of claim 1, wherein (a) comprises depositing electrophoretically the charge generating material onto the substrate from the liquid composition having a pH of about 7.

5. The process of claim 1, wherein (a) comprises depositing electrophoretically the charge generating material onto the substrate from a liquid composition comprised of water, the charge generating material, and an optional binder.

6. The process of claim 1, wherein (a) comprises depositing electrophoretically the charge generating material onto the substrate from a liquid composition comprised of an organic solution, the charge generating material, and an optional binder.

7. The process of claim 1, wherein (a) comprises creating an electric field for a period of time ranging from about 10 seconds to about 5 minutes to deposit the charge generating material on the substrate.

* * * * *